United States Patent [19]

Poirier

[11] Patent Number: 4,857,004

[45] Date of Patent: Aug. 15, 1989

[54] SAFETY GUARD FOR ELECTRICAL WALL OUTLET

[76] Inventor: Michel Poirier, 2, 7th Avenue, Forestville, Quebec, Canada

[21] Appl. No.: 242,339

[22] Filed: Sep. 9, 1988

Related U.S. Application Data

[63] Continuation-in-part of Ser. No. 110,867, Oct. 21, 1987, Pat. No. 4,793,818.

[30] Foreign Application Priority Data

Sep. 16, 1987 [CA] Canada ..... 547004

[51] Int. Cl.[4] ..... H01R 13/44

[52] U.S. Cl. ..... 439/140; 174/67; 439/136

[58] Field of Search ..... 174/67; 439/135, 136, 439/140, 142, 145

[56] References Cited

U.S. PATENT DOCUMENTS

| | | | |
|---|---|---|---|
| 4,607,136 | 8/1986 | Thomas | 439/136 |
| 4,711,634 | 12/1987 | Antone, II et al. | 439/136 |
| 4,760,215 | 7/1988 | Cook et al. | 174/67 |
| 4,774,384 | 9/1988 | Gregory | 439/136 |

*Primary Examiner*—P. Austin Bradley

*Attorney, Agent, or Firm*—Joseph Scafetta, Jr.

[57] ABSTRACT

The disclosure herein describes a safety guard which comprises a cover with openings adapted to be mounted over an electrical wall outlet and closure elements which are slideably mounted to the cover to expose or to cover the openings in registry with sockets of the wall outlet. The cover and the closure elements are structured so as to require two movements to displace the closure elements from a socket-covering position to a socket-exposing position. Also, a spring element connected between the cover and each closure element serves to bias the latter to the socket-covering position as the closure element is moved to expose the opening.

7 Claims, 5 Drawing Sheets

SAFETY GUARD FOR ELECTRICAL WALL OUTLET

This is a continuation-in-part of Ser. No. 110,867, now U.S. Pat. No. 4,793,818, filed Oct. 21, 1987.

FIELD OF THE INVENTION

The present invention pertains to a safety guard for mounting to an electrical outlet having one or more sockets. More particularly, the present invention relates to a safety guard for an electrical wall outlet designed to prevent access to such outlet when an electrical plug is not inserted.

BACKGROUND OF THE INVENTION

Various types of protective covers for electrical outlets have been described in patent litterature.

For example, U.S. Pat. No. 4,605,270 issued Aug. 12, 1986 to Aslizadeh describes a protective cover for an electrical outlet that comprises a pair of slideable closure plates and a pair of coil spring-actuated blocking plates wherein both plates are positioned within the boundaries of the rectangular openings in the front wall of the cover.

Also, U.S. Pat. No. 3,068,442 issued Dec. 11, 1962 to Kubik et al. describes a safety guard of the type described which comprises a box-like enclosure dimensioned to fit over the face plate of a wall socket having a pair of vertically aligned sockets and a slide member mounted for sliding vertical movement within the enclosure. The safety guard further comprises upper and lower bars which are disposed in overlaying relationship to the socket openings. The slide member is moveable downwardly to move the bars away from the socket openings and bring free areas into alignment with the socket openings. Each bar, upon release of the slide member is held in downward position if a plug is inserted in its socket opening and is free for independant return movement to its normal position by the urging of the springs if no plug is inserted in its opening.

Both of these protective systems provide for spring-actuated blocking plates which are moveable to automatically cover the socket openings if a plug is removed from a socket. However, they are not fully protective in that most children will be able to master the sliding movement of the plates, either accidentally or through observation.

OBJECTS AND STATEMENT OF THE INVENTION

It is an object of the present invention to provide a safety guard of the type described which eliminates the possibility of an accidental or intentional opening of these blocking plates over socket openings, especially by children.

This is achieved by providing a combination of a cover and of closure means which are so structurally connected that, in order to expose the socket openings, two movements are required on the part of the user: a first being in a perpendicular direction to the plane of the cover; the second being in a direction parallel to the plane of the cover.

The present invention therefore relates to a safety guard for an electrical outlet that has one or more sockets which comprises:

a cover adapted to be mounted over the electrical outlet and having one or more openings allowing an electrical plug to be connectingly received in the socket; said cover having a top edge, a bottom edge and opposite side edges; flexible means integrally formed along said top and bottom edges, said flexible means including engaging means thereon;

closure means movably mounted to the cover to expose or to cover the openings; said closure means including a top wall adapted to lie over at least a portion of the top wall of said cover and a pair of opposite side walls adapted to lie adjacent and parallel to said side edges of said cover; ramp means on said top wall of said closure means adapted to ride on said flexible means of said cover and to lockingly contact said engaging means of said cover; said engaging means and said ramp means cooperating to require two movements to displace the closure means from a socket-covering position to a socket exposing-position; and resilient means connected between the cover and the closure means serving to bias the closure means to the socket-covering position as the closure means are moved to expose the openings.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DETAILED DESCRIPTION OF THE INVENTION

Figure 1:
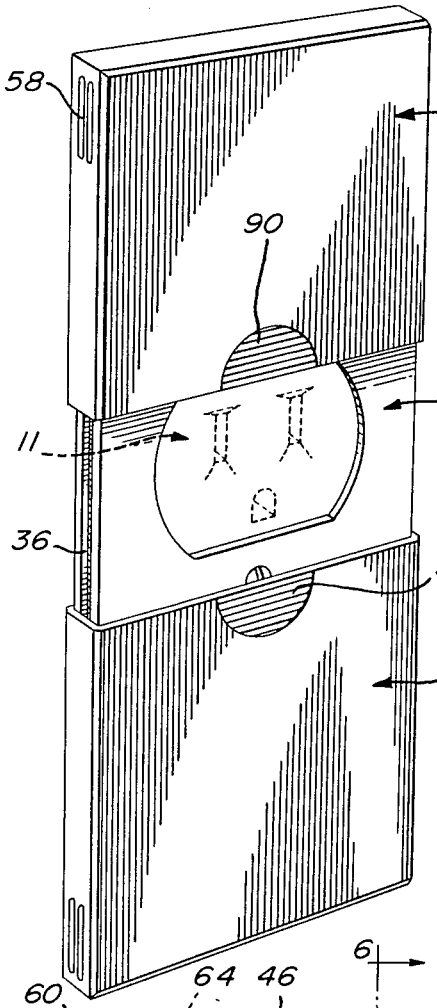
FIG. 1 is a front perspective view of a safety guard made in accordance with the present invention.

Referring to FIG. 1, one embodiment, generally denoted 10, of a safety guard for mounting to an electrical wall outlet (not shown) having one or more sockets 11 is shown.

The safety guard comprises a cover 12 to which is slideably mounted a pair of closure elements 14 and 16.

Figure 2:
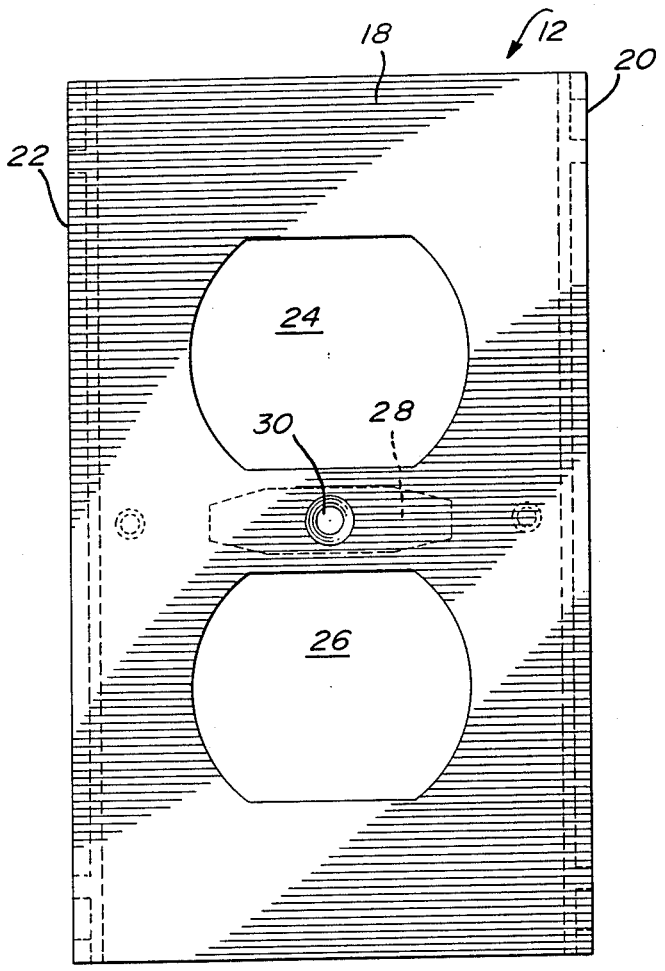
FIG. 2 is a front elevation of the cover of the safety guard shown in FIG. 1.
Figure 3:
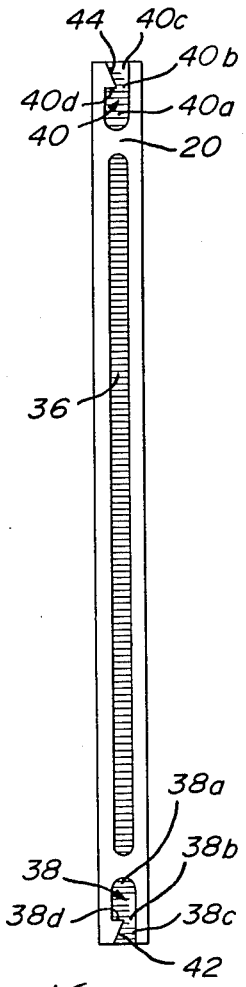
FIG. 3 is a side elevational view of the cover shown in FIG. 2.
Figure 4:
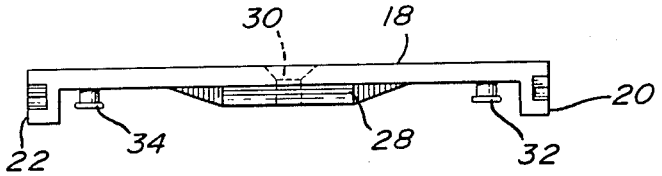
FIG. 4 is an end view of the cover shown in FIG. 2.

Referring to FIGS. 2, 3 and 4, the cover 12 comprises a rectangular unitary housing having a flat front wall 18 and a pair of lateraly opposing narrow side walls 20 and 22. The front wall 18 displays a pair of substantially similar openings 24 and 26; these openings are spaced apart by a central enlarged portion 28 integral with the rear face of the front wall and displaying a centrally disposed hole 30 to receive a screw (not shown) adapted to affix the cover 12 to a flat surface (in an upright position in the case of a conventional wall structure) in which is received a pair of sockets and a plate having a hole with which the hole 30 comes into registry.

The rear face of the front wall 18 has, in the central region thereof, a pair of studs 32 and 34, the function of which will be further described hereinbelow.

Each side wall 20, 22 of the cover displays, on the outer face thereof, a longitudinal groove 36 and a pair of opposite end recesses 38 and 40. Each recess 38, 40 is defined by an enlarged inner portion 38*a*, 40*a*, a constricted passage 38*b*, 40*b* and a tapering entrance portion 38*c*, 40*c* characterized by an inclined ramp 42, 44 respectively. The enlarged area 38*a*, 40*a* defines a stop wall 38*d*, 40*d* adjacent the constricted passage 38*b*, 40*b*.

Figure 6:
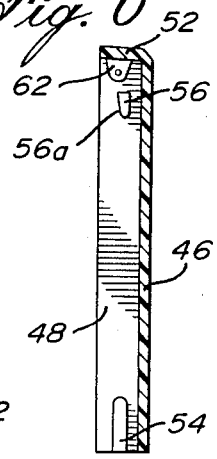
FIG. 6 is a cross-sectional view taken along line 6—6 of FIG. 5.
Figure 5:
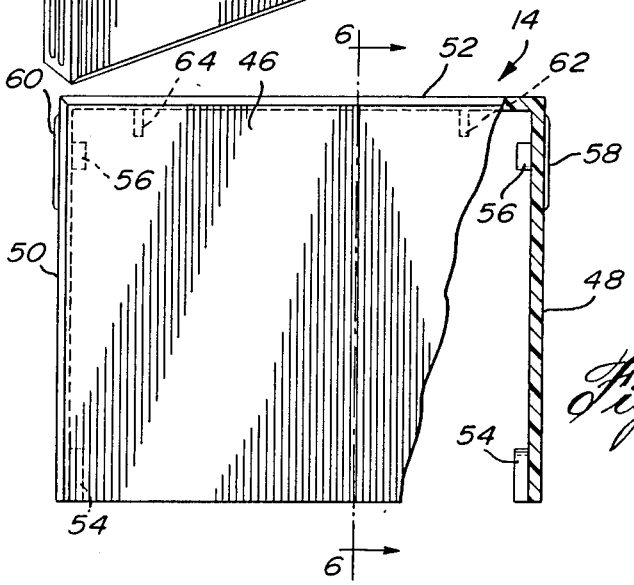
FIG. 5 is a front elevation, partially cut away, of a closure element of the safety guard shown in FIG. 1.

Referring to FIGS. 5 and 6, each closure element 14, 16 is identical in shape and only closure element 14 will be described. It comprises a rectangular housing having a flat front wall 46, a pair of opposite side walls 48 and 50 and an end wall 52.

The inner face of each side wall 48, 50 comprises a pair of bosses 54 and 56. Boss 54 has a generally rectangular configuration with a width slightly smaller than the width of groove 36 on the cover 12. Boss 56 has a generally trapezoidal configuration with its larger base slightly smaller than the width of the constricted passage 38*b* of recess 38 and with an inclined side face 56*a* which is adapted to slide along the inclined ramp 42. Finger-gripping projections 58 and 60 are provided on the outer face of the side walls 48 and 50, respectively, in the area of bosses 56. A pair of perforated projections 62 and 64 are integral with the inner face of the end wall 62.

Figure 7:
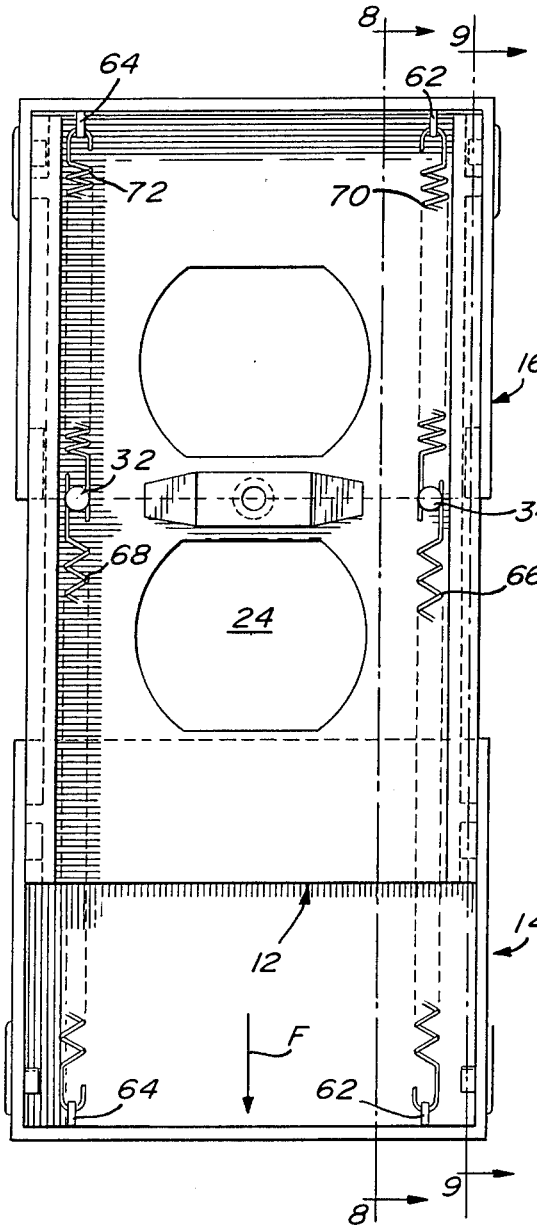
FIG. 7 is a rear elevation of the safety guard shown in FIG. 1.
Figure 8:
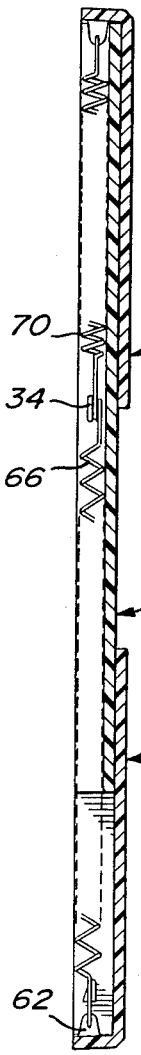
FIG. 8 is a cross-sectional view taken along line 8—8 of FIG. 7.
Figure 9:
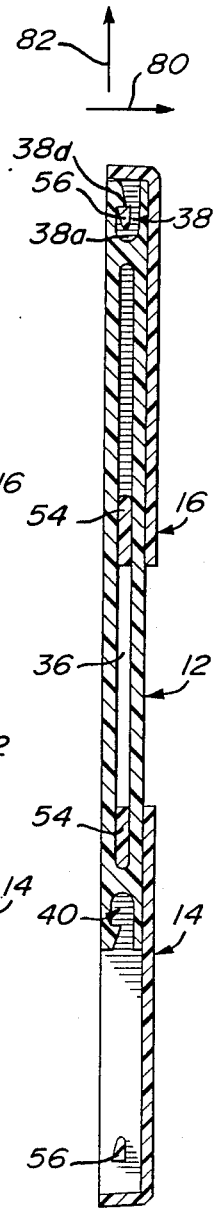
FIG. 9 is a cross-sectional taken along line 9—9 of FIG. 7.

As illustrated in FIGS. 7, 8 and 9, the closure elements 14 and 16 are slideably mounted to the cover 12, closure element 14 being shown in a socket-exposing position and closure element 16 shown in a socket-covering position. Both covers are biased to be maintained in a socket-covering position by means of two pairs of springs (66 and 68 for closure element 14 and 70 and 72 for the closure element 16). These springs are mounted, at one end, to the studs 32 and 34 of the cover and, at the opposite end, to the projections 62 and 64 of the closure elements. In the socket-exposing position, springs 66 and 68 are tensioned and in extended condition while, in the socket-covering position, springs 70 and 72 are in a somewhat less tensioned condition. When the force indicated by arrow F (see FIG. 7) is released, springs 66 and 68 urge the closure element 14 to a socket-covering condition.

Referring more particularly to FIG. 9, the bosses 54 of the closure elements 14 and 16 cooperate with the grooves 36 of the cover to allow the longitudinal sliding movement of the closure elements relative to the cover. The opposite ends of grooves 36 limit the displacement of the closure elements. In the socket-opening condition, boss 56 is outside the recess 40 while in the socket-covering position, boss 56 is prevented from sliding, as shown on the left side of FIG. 9, as a result of it bearing against the stop wall 38*d* in the enlarged portion 38*a* of recess 38.

To move the closure elements from a socket-covering position to a socket-exposing condition, two movements are required: a first which is in the direction of arrow 80 causing the boss 56 to be free from the stop wall 38*d*, 40*d* and a second movement in the longitudinal direction of arrow 82 allowing the boss 56 to pass in the constricted passage 38*b*, 40*b* and out through the entrance portion 38*c*, 40*c*. As shown on the left side of FIG. 9, sliding movement in the direction of arrow 82 is prevented by the engagement of boss 56 with the stop wall 38*d* of the recess; movement in direction of arrow 80 being first required. Hence, the structural configuration of the cover and the closure elements cooperates to provide a safeguard against accidental or intentional opening of the closure elements especially by children.

This two-movement requirement is also present in the embodiment illustrated in FIGS. 10–13 which show a cover 100 and a pair of closure elements 102 and 104.

Figures 10, 11:
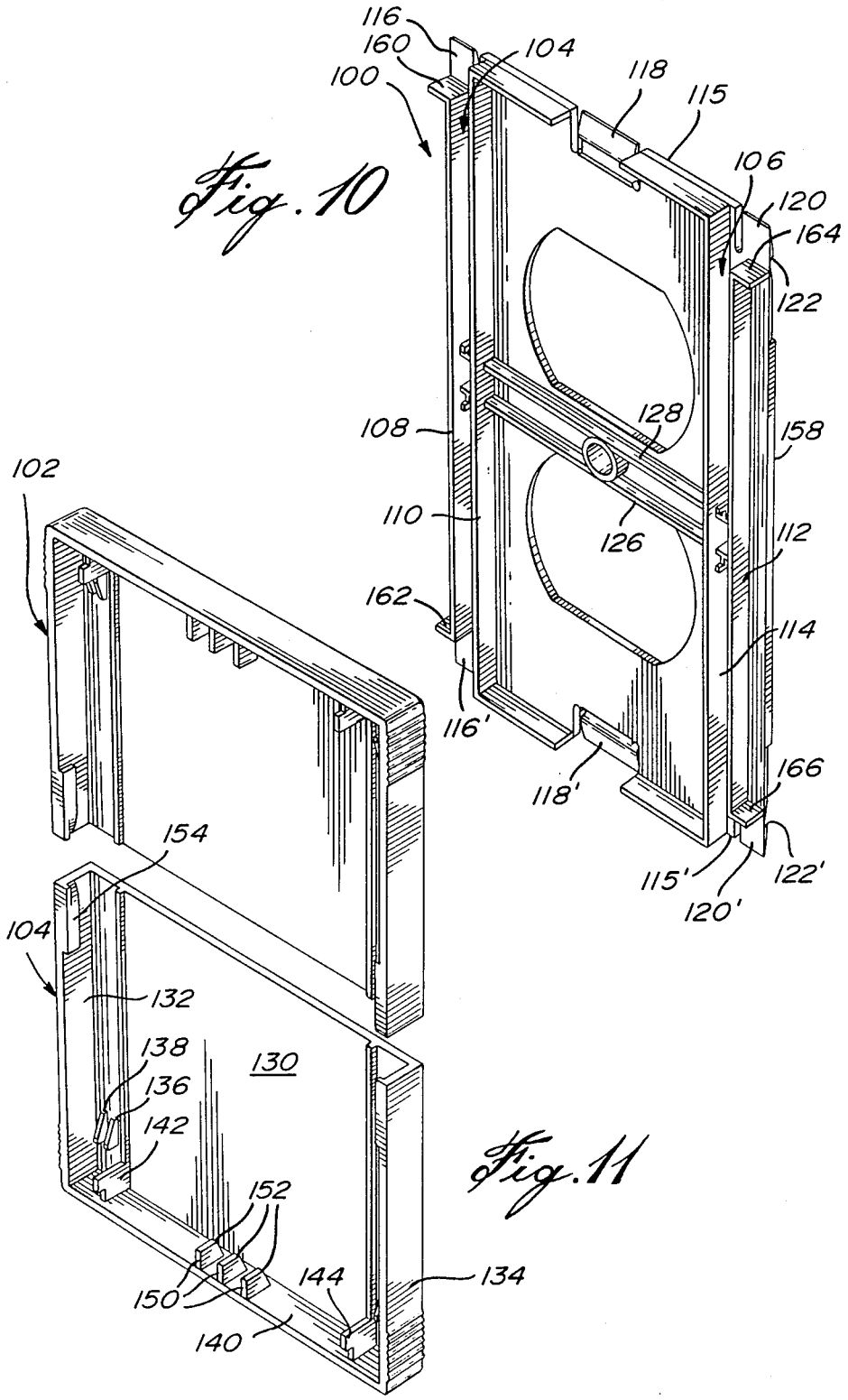
FIG. 10 is a rear perspective view showing the cover of another embodiment of a safety guard made in accordance with the present invention.
FIG. 11 is a rear perspective view showing the closure elements of the embodiment illustrated in FIG. 10.

Referring more particularly to FIG. 10, the cover 100 has a pair of vertical spring-receiving channels 104 and 106, respectively made of walls 108, 110 and 112, 114. The upper edge 115 is formed of three flexible tongues 116, 118, 120, the outermost tongues 116 and 120 each displaying a lip (122 on tongue 120). The lower edge 115', of the cover is identically constructed to the upper edge with tongues 116, 118 and 120. Two parallel ribs 126, 128 extend horizontally to reinforce the cover transversely. Walls 108 and 114 have upper and lower outwardly projecting flanges 160, 162, 164 and 166.

Figure 12:
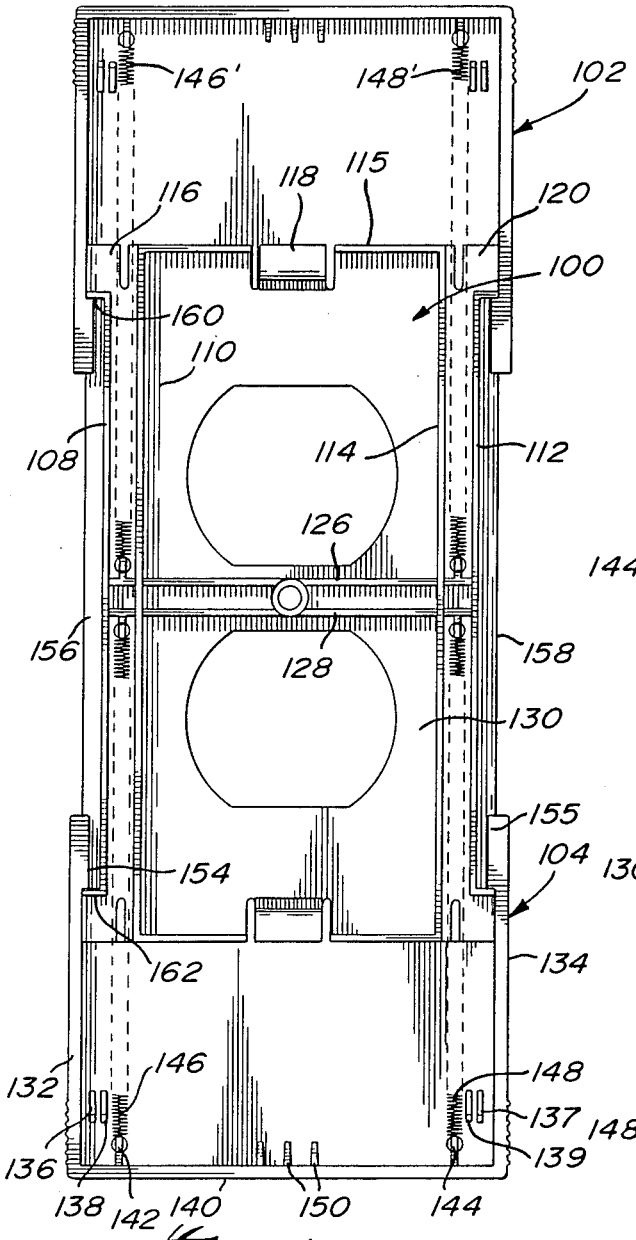
FIG. 12 is a rear elevational view of the assembled safety guard of FIGS. 10 and 11, showing the closure elements in the opened position.
Figure 13:
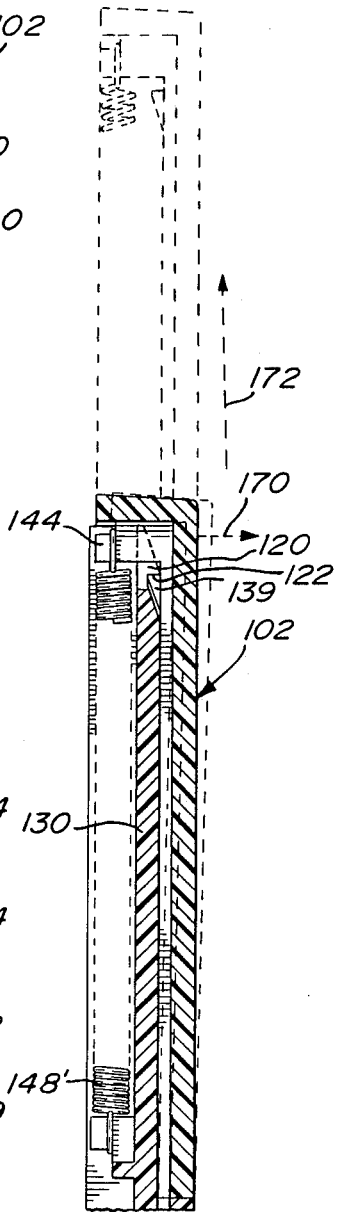
FIG. 13 is a side cross-sectioned view of the upper part of the safety guard shown in FIG. 12.

Referring to FIGS. 11 and 12, the closure elements 102, 104 are identically constructed and description will be made, therefore, only to the lower closure element 104. The inner wall 130 thereof displays, adjacent each side wall 132, 134, a pair of parallel small sloping ramps 136, 138 and ramps 137, 139 on which the flexible tongues 116, 120 are adapted to slide during closure. The transverse bottom wall 140 displays a pair of retaining clips 142, 144 for connecting the opposite ends of springs 146, 148, as well as three centrally disposed ribs 150 each having an inclined inner surface 152 on which the flexible central tongue 118 of the cover is adapted to slide during closure. Each side walls 132, 134 includes an inner projection 154, 155 which is spaced from the inner wall 130 to slidingly receive therebetween the side edges 156, 158 of the cover. These projections also act as stoppers when contacted by the flanges 160, 162, 164, 166 of the cover to limit the opening of the closure elements.

Upon closure of element 102 under the action of springs 146, 148, the ramps 136, 138, 137, 139 slidingly contact tongues 116, 120 which flex slightly, the straight rear edges of the tongues passing by the lips 122 to secure the closure elements to the cover. Also, rib surfaces 152 slide on tongue 118 which flexes slightly and further secure the closure elements to the cover.

To desengage, a pulling movement in the direction of arrow 170 (see FIG. 13) is first effected to free the straight edges of the ramps 136, 137, 138, 139 from the tongue lips 122; this is followed by a second pulling movement as indicated by arrow 172 against the action of the springs to expose the electrical socket.

Although the invention has been described above in relation to one specific form, it will be evident to the person skilled in the art that it may be refined and modified in various ways. For example, to facilitate the opening of the closure elements, finger-friction surfaces 90 and 92 may be provided thereon. Therefore, it is wished to have it understood that this invention should not be limited in interpretation except by the terms of the following claims.

The embodiments of the invention in which an exclusive property or privilege is claimed are defined as follows:

1. A safety guard for an electrical outlet having one or more sockets, comprising:

a cover adapted to be mounted over said electrical outlet and having a top wall with one or more opening means allowing an electrical plug to be connectingly received in said sockets; said cover having a top edge, a bottom edge and opposite side edges; flexible means integrally formed along said top and bottom edges, said flexible means including engaging means thereon;

closure means movably mounted to said cover to expose or to cover said opening means; said closure means including a top wall adapted to lie over at least a portion of the top wall of said cover and a pair of opposite side walls adapted to lie adjacent and parallel to said side edges of said cover; ramp means on said top wall of said closure means adapted to ride on said flexible means of said cover and to lockingly contact said engaging means of said cover; said engaging means and said ramp means cooperating to require two movements to displace said closure means from a socket-covering position to a socket-exposing position; and resilient means connected between said cover and said closure means to bias said closure means to said socket-covering position as said closure means are moved to expose said opening means.

2. A safety guard as defined in claim 1, wherein said closure means consist of a pair of identically-shaped rectangular elements adapted to fully cover said cover having a rectangular shape.

3. A safety guard as defined in claim 1, wherein said closure means move in a longitudinal parallel direction relative to said cover; said movements consisting of a first movement in a direction perpendicular to said longitudinal direction, followed by a second movement in said longitudinal direction.

4. A safety guard as defined in claim 3, wherein the inner face of each said side walls of said closure means includes projection means adapted to slidingly engage said side edges of said cover to secure said closure means to said cover.

5. A safety guard as defined in claim 4, further comprising finger-gripping means on the outer surface of said side walls of said closure means in the area of said projection means.

6. A safety guard as defined in claim 4, wherein the under face of the top wall of said cover includes opposite longitudinal spring receiving channels and spring connecting means at substantially mid-point thereof; and wherein said closure means include an end wall having an inner face; spring connection means mounted on said inner face of said end wall; said resilient means being attached, at opposite ends thereof, to said spring connection means of said cover and of said closure means.

7. A safety guard as defined in claim 6, wherein said resilient means is a spring.

* * * * *